US005597000A

United States Patent [19]

Gerber

[11] Patent Number: 5,597,000

[45] Date of Patent: Jan. 28, 1997

[54] METHOD AND APPARATUS FOR HAIR STYLING

[76] Inventor: Lisa Gerber, 2055 E. Hampton Ave. #184, Mesa, Ariz. 85204

[21] Appl. No.: 415,522

[22] Filed: Apr. 3, 1995

Related U.S. Application Data

[63] Continuation-in-part of Ser. No. 242,114, May 13, 1994, abandoned.

[51] Int. Cl.[6] ..... A45D 8/22; A45D 8/28

[52] U.S. Cl. ..... 132/279; 132/273; 132/278; 132/133; 132/145; 24/518

[58] Field of Search ..... 132/254, 256, 132/255, 273, 279, 278, 145, 133; 24/518, 543, 579.1; D28/29, 32, 33

[56] References Cited

U.S. PATENT DOCUMENTS

| | | | |
|---|---|---|---|
| 573,887 | 12/1896 | Kraus . | |
| 649,848 | 5/1900 | Koenig | 132/279 |
| 918,203 | 4/1909 | Schwarzer . | |
| 1,596,737 | 8/1926 | Johnson | 132/133 |
| 1,609,208 | 11/1926 | Schneeberger et al. | 132/279 |
| 1,956,090 | 4/1934 | Behr | 132/256 |
| 2,159,709 | 5/1939 | Quetin | 132/133 |
| 2,718,894 | 9/1955 | Gresham et al. | 132/133 |
| 3,998,233 | 12/1976 | Dorr | 132/279 |
| 5,165,429 | 11/1992 | Miller | 132/255 |
| 5,174,312 | 12/1992 | Adams . | |
| 5,284,167 | 2/1994 | Gill . | |

*Primary Examiner*—Gene Mancene
*Assistant Examiner*—Pedro Philogene
*Attorney, Agent, or Firm*—Harness, Dickey & Pierce, P.L.C.

[57] ABSTRACT

A method and apparatus for styling hair includes a latch mechanism for releasably securing a hair styling device about a plurality of hair strands. The latch mechanism is adapted to interconnect first and second pivotally interconnected elongated members of the hair styling device and includes a first latch member disposed substantially adjacent a first end of the first elongated member and a second latch member disposed substantially adjacent a first end of the second elongated member. The first and second latch members are adapted to releasably engage one another. At least one of the first and second elongated latch is elastically deformable. In the preferred embodiment, each of the latch members includes a first segment having a free end spaced apart from an adjacent surface of its respective elongated member. Each free end cooperates with the adjacent surface to define an opening therebetween.

16 Claims, 3 Drawing Sheets

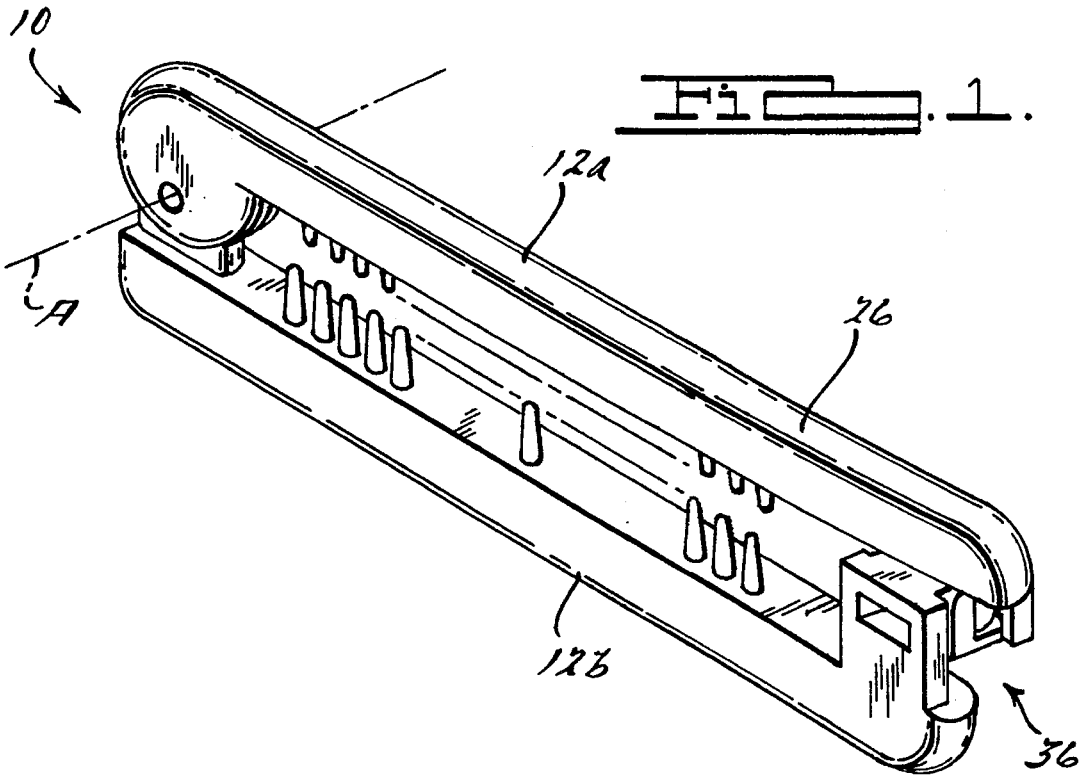
FIG. 1.
FIG. 2.
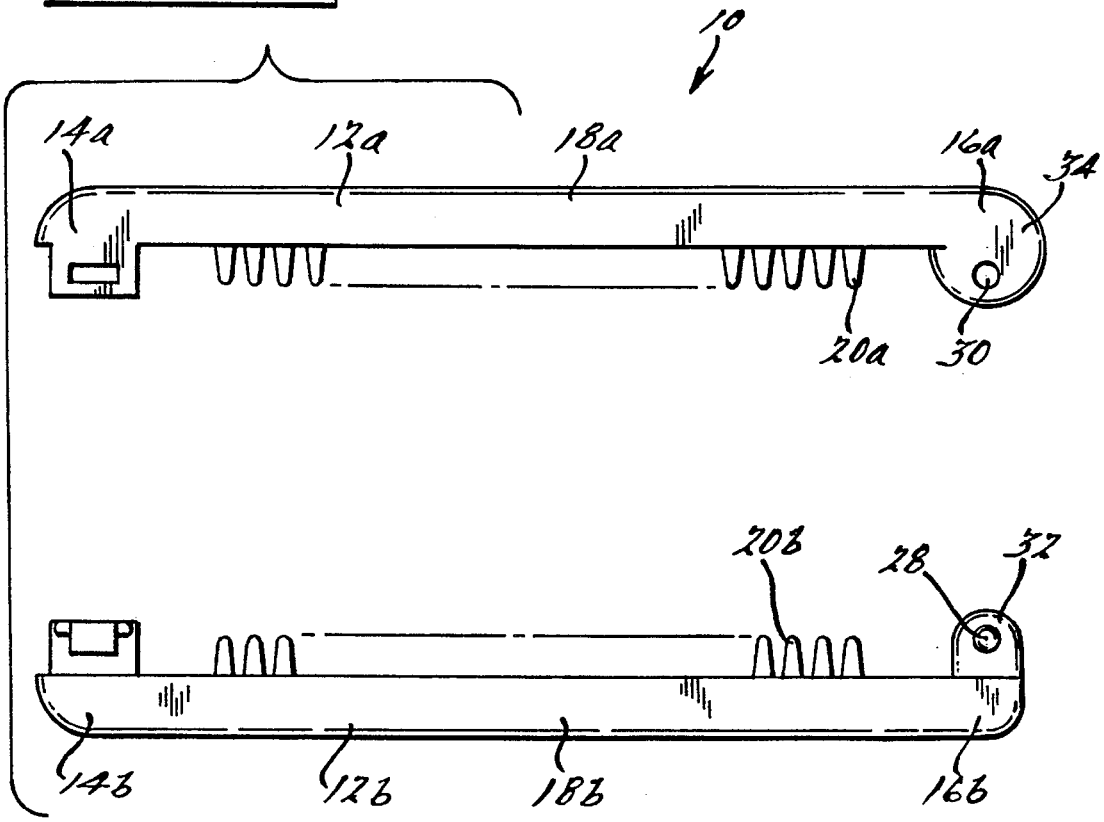

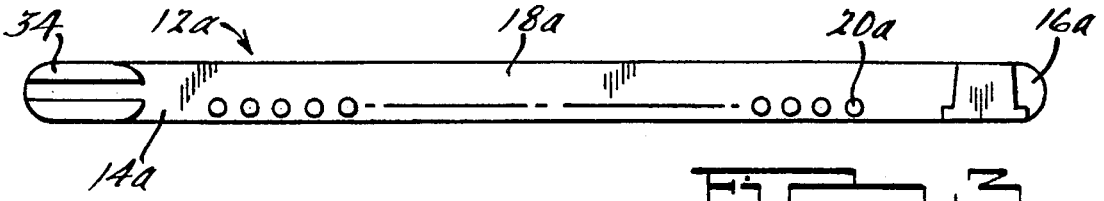
FIG. 3.
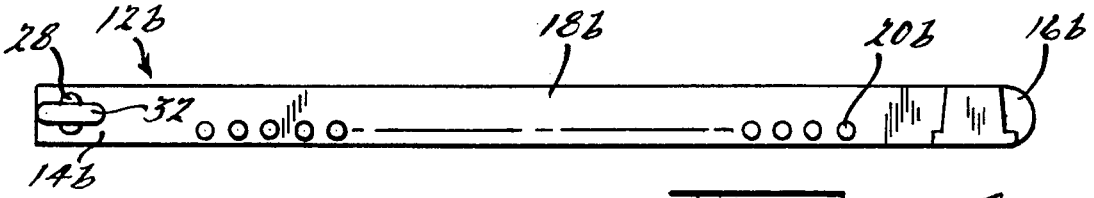
FIG. 4.
Pull Hair Rearward In A Ponytail (A)
↓
Open Latch Mechanism (B)
↓
Position Apparatus About The Ponytail And Close The Latch Mechanism (C)
↓
Slide Apparatus To Ends Of Shortest Hair Of Ponytail (D)
↓
Fold The Free End Of The Ponytail Upon Itself To Form A Roll (E)
↓
Continue To Roll The Formed Roll Toward The Head Until Adjacent Thereto (F)
↓
Secure With Pins As Necessary (G)
FIG. 5.
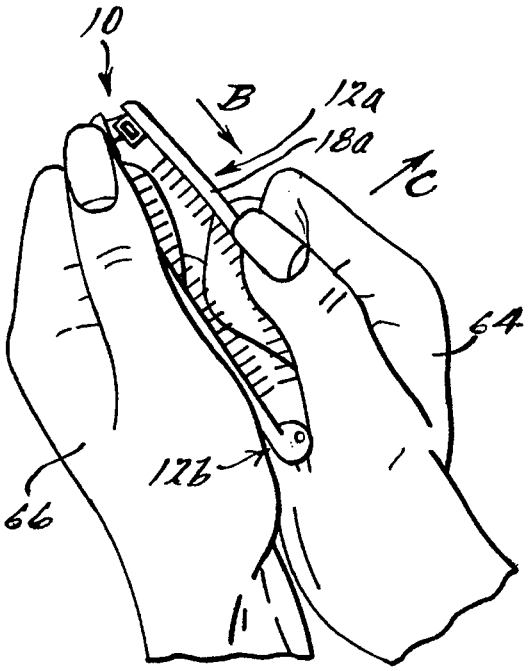
FIG. 6.

METHOD AND APPARATUS FOR HAIR STYLING

This is a continuation-in-part application of U.S. Ser. No. 08/242,114, filed May 13, 1994 now abandoned.

FIELD OF THE INVENTION

The present invention relates generally to a method and apparatus for styling hair. More specifically, the present invention is related to a method and apparatus to securely dress the hair in a French twist.

BACKGROUND OF THE INVENTION

During hair dressing and preparation activities, a variety of hair dressing implements are employed for the purpose of maintaining the style and appearance of a person's hair. It is often desired to group strands of hair together so as to achieve a particular style. For example, pony tails are often quite popular, not only for the ease in which it may be cared for, but also for the comfort that it affords in keeping the hair away from the neck in hot weather. There are various other hair styles in which several strands of hair join together for the purpose of fashion.

Heretofore, numerous devices have been developed for use in connection with the creation and maintenance of various hair styles. One of the most commonly known of such prior devices is referred to as a barrette. In their most basic sense, barrettes are typically formed of two opposed rib-like members hinged for relative movement therebetween at a first juncture of two ends thereof and releasably fastenable at the juncture of the other two ends. One or both of the rib-like members may be toothed to better retain the hair between the members and laterally position the barrette with respect to the hair. While this prior art structure has proven satisfactory in use with some hair styles, certain styling procedures are difficult, if not impossible, to accomplish with such a device.

In addition to barrettes, a number of other devices are described in patents which have issued on various types of hair retaining devices and hair styling devices. For example, U.S. Pat. No. 3,998,233, issued Dec. 21, 1976 to Dorr, describes a barrette-type structure which is adapted to rotate 360 degrees at a joined end thereof. U.S. Pat. Nos. 573,887; 673,098; 918,203; 1,596,737; 2,159,709; 2,718,894; 5,174,312; 5,284,167; and 5,335,680 disclose various hairstyling devices or hair ornaments which are pivotally joined at a first end and releaseably interconnected at a second end. Various mechanisms are disclosed throughout the prior art, including those discussed immediately above, for releasably securing hair styling devices in a closed condition.

While prior known hair styling devices have proven to be relatively commercially successful, none are without associated drawbacks or inherent limitations. For example, many of the known prior devices are subject to inadvertent opening. This problem is particularly prevalent when it is necessary to grasp and secure large quantities of hair to create such hair styles as a ponytail. Additionally, most prior devices are required to be positioned in the hair such that they are visible during use. Further, prior devices are limited in application and are generally not suitable for preparing complex hair styles such as a French twist hair style.

Accordingly, it is an object of the present invention to provide a different type of hair styling apparatus which is novel both in its structure and its use which overcomes the disadvantages associated with the prior art.

A related object of the present invention is to provide a hair styling apparatus that is capable of securely retaining large amounts of hair, but which is not subjected to inadvertent opening.

It is another object of the present invention to provide a hair styling apparatus which can be used to create a French twist hair style that has a compact and simple construction with a minimal number of parts.

It is yet another object of the present invention to provide a hair styling apparatus including two substantially identical parts constructed from an elastically deformable injection molded plastic.

SUMMARY OF THE INVENTION

Thus, the present invention is directed towards overcoming the disadvantages associated with previously known hair styling devices, including by not limited to those discussed above, by providing a method and apparatus incorporating a novel latching mechanism.

In a first aspect, the present invention is directed to a latch mechanism for releaseably securing a hair styling device about a plurality of hair strands. The hair style device is of the type including first and second pivotally interconnected elongated members. The latch mechanism includes a first latch member disposed substantially adjacent a first end of the first elongated member. The latch mechanism further includes a second latch member disposed substantially adjacent a first end of the second elongated member. The first and second latch members are adapted to releasably engage one another. At least one of the first and second latch members is elastically deformable.

In a second aspect, the present invention is directed to a latch mechanism for a hair styling apparatus. The hair styling apparatus is specifically adapted for styling hair in a French twist hair style and includes an upper and a lower elongated member. The upper and lower elongated members include first and second rows of hair engaging teeth, respectively. The first row of hair engagement teeth extend from a lower side of the upper elongated member and the second row of hair engagement teeth extend from an upper side of the lower elongated member. The upper and lower elongated members are pivotally interconnected at first ends thereof. The hair styling apparatus further includes a latch mechanism for releasably securing a second end of each of the first and second elongated members to hold a plurality of strands of hair therebetween. The latch mechanism includes a first latch member disposed substantially adjacent the first end of the first elongated member and a second latch member disposed substantially adjacent the first end of the second elongated member. The first and second latch members are adapted to releasably engage one another. At least one of the first and second latch members is elastically deformable.

In a third aspect, the present invention is directed to a method of forming a French twist hair style. The method of forming a French twist hair styling includes forming a generally rearwardly extending ponytail from a plurality of strands of hair. Next, the hair styling apparatus of the type including first and second elongated members is provided. The first and second elongated members are pivotally interconnected. The hair styling apparatus further includes a pair of substantially identically constructed latch members. A first latch member of the pair of latch members is attached to the first elongated member and a second latch member of the pair of latch members is attached to the second elongated member. Next, the hair styling apparatus is positioned about the ponytail and the latch members are releasably interconnected. Subsequently, the hair styling apparatus is longitudinally located substantially adjacent the ends of the shortest hairs of the ponytail. A roll is formed by folding a free end of the ponytail upon itself and the formed roll is continually rolled until it is substantially adjacent the hair.

In a fourth aspect, the present invention is directed to a method of releasably and securely clamping hair in a hair styling apparatus which includes first and second pivotally interconnected elongated members. The method of releasably and securing clamping includes the steps of providing a first latch member substantially adjacent a free end of the first elongated member and a second latch member substantially adjacent a free end of the second elongated member. The first and second latch members are substantially identical. Next, the first and second latch members are cooperatively interconnected by elastically deforming at least one of the first and second latch members. Preferably, the the step of cooperatively interconnecting the first and second latch members further includes the steps of urging a first free end of the first latch member in a first direction past a second free end of the latch member, and urging one of the first and second free ends in a second direction substantially perpendicular to the first direction in response to urging of the first free end in the first direction.

BRIEF DESCRIPTION OF THE DRAWINGS

Further objects, features and advantages of the present invention will become apparent from analysis of the following written specification and the accompanying drawing and the appended claims in which:

FIG. 1 is a front and side perspective view of a hair styling apparatus constructed in accordance with the teachings of a preferred embodiment of the present invention;

FIG. 2 is an exploded view of the hair styling apparatus of FIG. 1;

FIG. 3 is a bottom view of an upper elongated member of the hair styling apparatus of FIG. 1 illustrating a first plurality of teeth formed thereon;

FIG. 4 is a top view of a lower elongated member of the hair styling apparatus of FIG. 1 illustrating a second plurality of teeth formed thereon;

FIG. 5 diagrammatically illustrates the general steps of a preferred method of forming a French twist hair style according to this invention;

FIG. 6 is a perspective view illustrating step B of FIG. 5;

DETAILED DESCRIPTION OF THE PREFERRED EMBODIMENT

Figure 7:
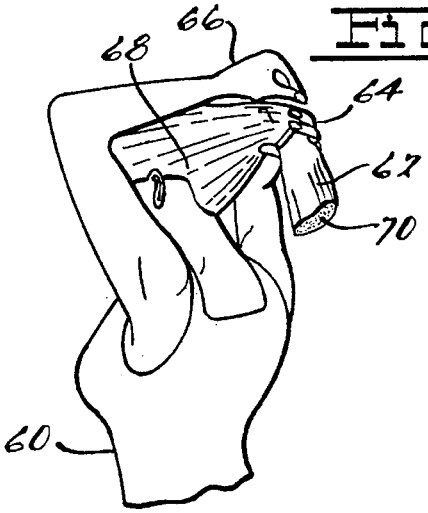
FIG. 7 is a perspective view illustrating step D of FIG. 5.

The present invention is specifically directed to a method and apparatus for creating a hair style which is commonly referred to as a French twist. More particularly, the apparatus of the present invention is directed to a latch mechanism for a hair styling apparatus which includes an improved latch mechanism which is novel both in construction and use. A first method of the present invention is directed to the use of the latch mechanism to securably and releasably grasp hair. The second method of the present invention is directed to the use of the improved apparatus for creating a French twist hair style. Much of the focus of this attention is directed toward latch mechanism of the present invention and the uses of the latch mechanism.

Certain terminology is used in the following description for convenience only and is not intended to be limiting. For example, words such as "upper" and "lower" and "clockwise" and "counterclockwise" designate direction or orientation in the drawings to which reference is being made. Also in the drawings, where similar reference characters designate like parts throughout the several views, illustrated is a preferred embodiment of the present invention.

Turning now to FIGS. 1–4, a hair styling apparatus 10 constructed in accordance with the teachings of a preferred embodiment of the present invention is illustrated. More particularly, FIG. 1 shows a front and side perspective view of the hairstyling apparatus 10 and FIG. 2 illustrates an exploded view. The hair styling apparatus 10 is shown to generally include an upper, or first elongated member **12*a* and a lower, or second elongated member 12*b*. FIGS. 3 and 4 show a bottom view of the upper elongated member 12*a* and a top view of the bottom elongated member 12*b*, respectively. The upper and lower elongated members 12*a*, 12*b* are substantially similarly constructed to each include a first end 14*a*, 14*b*, a second end 16*a*, 16*b*, and a central portion 18*a*, 18*b* therebetween. It will be appreciated by those skilled in the art that the similarities between the upper and lower elongated members 12*a*, 12*b*** contributes to reduced manufacturing costs.

In the preferred embodiment, the first and second elongated members **12*a*, 12*b* are formed to include first and second rows of equally spaced apart hair engaging teeth 20*a*, 20*b*. The teeth of the first and second rows of teeth 20*a*, 20*b* are disposed in first and second planes, respectively. The first and second planes are slightly spaced apart. Further, in the preferred embodiment, the teeth of the first and second rows of teeth 20*a*, 20*b* are equal in number and are spaced such that each tooth of the first row of teeth 20*a* is aligned with a tooth of the second row of teeth 20*b*, adjacent teeth being in an overlapped relationship. When the hair apparatus 10 is in a closed position (as shown in FIG. 1) about a plurality of strands of hair, the first and second rows of teeth 20*a*, 20*b* cooperatively function to laterally subdivide the plurality of strands of hair, thereby laterally locating the hair styling apparatus 10** with respect to the strands of hair.

In the exemplary embodiment illustrated, each of the first and second elongated members **12*a*, 12*b* includes a substantially convex exterior surface 26. In one application, the first and second elongated members 12*a*, 12*b* are approximately 3.25 inches in length, 3/16 inch in width and 3/16 inch in height. The length of each tooth is approximately 1/8 inch. In a closed condition (as shown in FIG. 1 ), the overall height of the hair styling apparatus 10 is approximately 5/8 inch. As will become more apparent below, the compact construction of the hair styling apparatus 10** significantly facilitates creation of a French twist hair style.

To provide means for pivotally interconnecting the first and second elongated members **12*a*, 12*b* at their first ends 14*a*, 14*b*, the hair styling apparatus 10 of the present invention is formed to include a generally spherical protrusion 28 associated with one of the elongated members 12*a*, 12*b* and a cylindrical aperture 30 associated with the other of the elongated members 12***a*, 12*b*. In the exemplary embodiment of the hair styling apparatus 10 of the present invention illustrated throughout the drawings, the lower elongated member 12*b* includes at its second end 16*b*, an upper extending dependent portion 32. The generally spherical protrusion 28 extends from both sides of the dependent portion 32.

A pair of spaced apart substantially planar portions 34 are provided adjacent the second end 16*a* of the upper elongated member 12*a*. The cylindrical aperture 30 passing through both of the planar portions 34 is adapted to pivotally receive the spherical protrusions 28 of the lower elongated member 12*b*. In this regard, the pair of substantially planar portions 34 are elastically deformable to thereby allow insertion of the spherical protrusions 28. Once the spherical protrusions 28 engage the cylindrical aperture 30, the pair of substantially planar portions 34 elastically return to their original configuration, thereby pivotally interconnecting the first and second elongated members 12*a*, 12*b*. Referring to FIG. 1, the spherical protrusions 28 and cylindrical aperture 30 cooperate to define an axis A, about which the first and second elongated members 12*a*, 12*b* are permitted to relatively rotate.

Figure 10A:
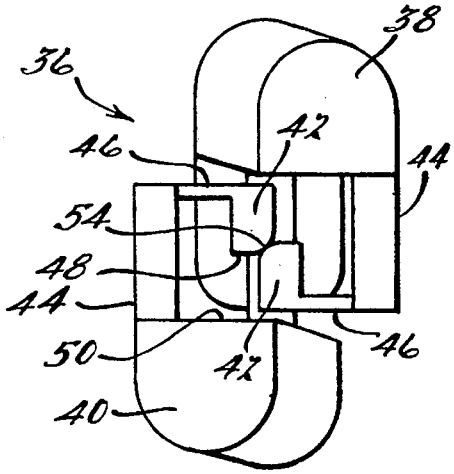
FIGS. 10A–10C illustrate a series of views showing the relationship of the first and second latch members as the latch mechanism of FIG. 1 is moved between an open position and a closed position.
Figure 10B:
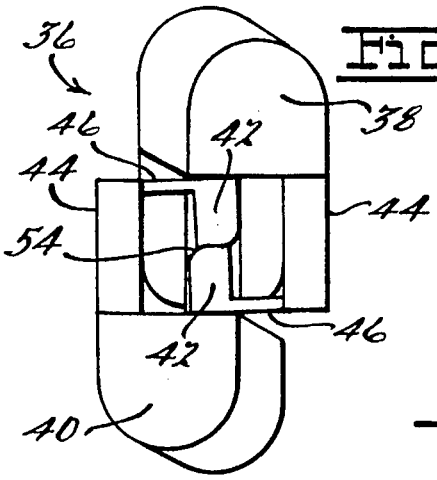
Figure 10C:
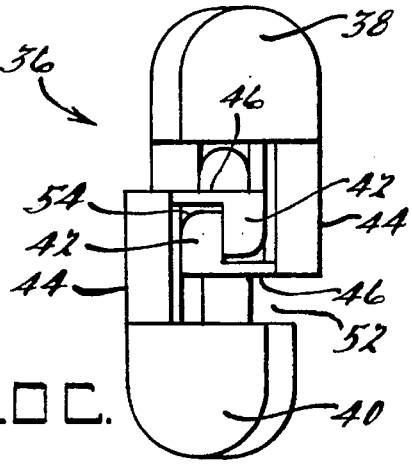

Referring additionally to FIGS. 10A–10C, the hair styling apparatus 10 of the present invention is shown to further include a latch mechanism 36. In the preferred embodiment, the latch mechanism 36 includes first and second substantially identical latch members 38, 40 located at the second ends 16*a*, 16*b* of the first and second elongated members 12*a*, 12*b*, respectively. Each latch member 38, 40 includes a generally U-shaped cross-section defined by a first segment 42, a second segment 44, and an intermediate segment 46 interdisposed therebetween. Each of the first segments 42 include a free end 48 spaced apart from an adjacent surface 50 of its respective elongated member 12*a*, 12*b*. The free ends 48 cooperate with the adjacent surfaces 50 to define an opening 52 therebetween. Each of the free ends 48 of the latch members 38, 40 is formed to include a camming surface 54, the significance of which will become more apparent below.

At least one of the latch members 38, 40 is elastically deformable so that the size of the opening 52 between the free end 48 and the adjacent surface 50 can be varied by elastically rotating the latch member 38, 40 with respect to the elongated member 12*a*, 12*b* about an axis substantially parallel to an axis defined by the elongated member 12*a*, 12*b*. In the preferred embodiment, each of the first and second latch members 38, 40 is elastically deformable. Further, in the preferred embodiment, the first and second latch members 38, 40 are constructed of an elastically deformable injection molded plastic. However, it will be appreciated by those skilled in the art that any of a number of suitable materials can be utilized.

The hair styling apparatus 10 of the present invention is specifically designed to create a French twist hair style. Referring generally to FIG. 5, the general steps of a preferred method of the present invention are diagrammatically illustrated. First, a user 60 brushes the hair rearwardly so as to form a ponytail configuration 62. While a first hand 64 grips the ponytail 62, the other hand 66 securely fastens the hair styling apparatus 10 thereabout substantially adjacent the head 68. Next, the hair styling apparatus 10 is translated along the length of the ponytail 62 until the ends of the shortest hairs are encountered.

Figure 8:
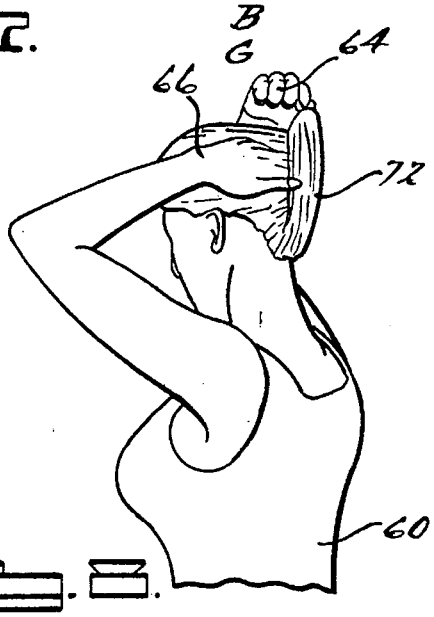
FIG. 8 is a view similar to FIG. 4 illustrating step F of FIG. 5.

As shown in FIGS. 7 and 8, a free end 70 of the ponytail 62 is rolled forwardly towards the head 68 to form a vertically oriented roll 72. The vertically oriented roll 72 is rolled forwardly, as shown in FIG. 8, until the hair styling apparatus 10 is wrapped into the roll 72 and the roll 72 is positioned comfortably against the head 68.

Figure 9:
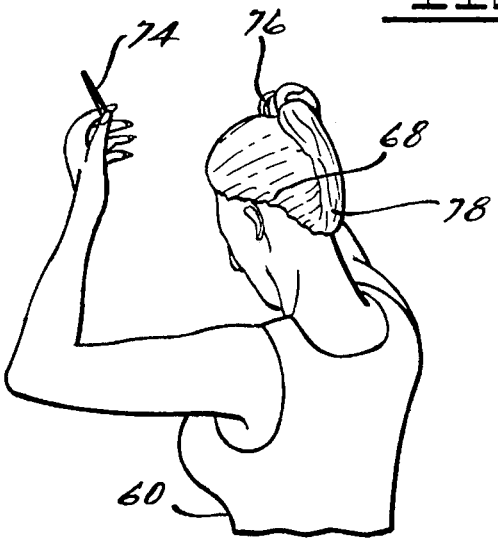
FIG. 9 is a perspective view illustrating step G of FIG. 5.

Referring to FIG. 9, in order to complete the hair style, one or more pins 74 are inserted from an upper end 76 of the roll 72 downwardly, thereby securing the hair adjacent the head 68. It will be appreciated by those skilled in the art that it may be necessary to additionally insert one or more pins 74 from a lower end 78 of the roll 72 upwardly. The result of this exemplary application is a hair style commonly referred to as a French twist.

Referring specifically to FIGS. 10A–10C, the steps of engaging the latch members 38, 40 is illustrated. In use, the first and second elongated members 12*a*, 12*b* are pivoted towards about Axis A (as shown in FIG. 1 ) one another until the first segments 42 begin to pass through the opening 52 of the opposite latch member 38, 40 (as shown in 10A). In this position, the camming surface 54 of the free ends 48 of the first segments 42 engage one another. Slight urging of the latch members 38, 40 in a horizontal direction towards one another causes opposed vertical urging of the free ends 48. This vertical urging of the free ends 48 slightly elastically deforms each of the latch members 38, 40 (as shown in FIG. 10B), thereby increasing the size of the opening 52 between the free ends 48 and the adjacent surfaces 50 and thereby allowing the first segments 42 to horizontally pass therethrough. Once the first segments 42 horizontally pass, the first and second latch members 38, 40 elastically return their original shape (as shown in FIG. 10C), thereby preventing inadvertent disengagement of the latch members 38, 40.

Referring to FIG. 6, the method of disengaging the first and second latch members 38, 40 is illustrated. As shown, one of the elongated members 12*a* is firmly grasped along its length by the first hand 64. The second hand 66 is utilized to grasp the other of the elongated members 12*b*, pulling the elongated member 12*b* outward in a first direction C at its central portion 18*a*, thereby bowing the elongated member 12*a*. Simultaneously, the latch member 38, 40 are slid in a second direction D substantially parallel to direction C until the elongated members 12*a*, 12*b* are free to rotate relative to one another about Axis A.

While not specifically illustrated herein, it will be readily appreciated by those skilled in the art that variation to the French twist hair style can be readily created with the hair styling apparatus 10 of the present invention. For example, in a first variation, the hair may be parted horizontally across the back of the head with only the upper half being drawn into a ponytail. Next, the ponytail is prepared according to the steps described immediately below. In a second variation, the hair is parted vertically across the back of the head, thereby forming two ponytails of substantially equal proportion. Subsequently, each ponytail is prepared according to the steps outlined above. In a third variation, the initial step involves forming the ponytail at the top of the head. According substantially to the steps outlined above, the roll is formed on the top of the head. It will be understood that the present invention can be practiced other than as specifically described therein. Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to those skilled in the art upon a study of the drawings, specification and following claims:

What is claimed:

1. A hair styling device comprising:

a first elongated member having a longitudinal axis;

a second elongated member pivotally attached to said first elongated member for relative rotation thereto;

a first latch member extending from said first elongated member, said first latch member having a generally U-shaped cross section in a direction substantially normal to said longitudinal axis; and a second latch member extending from said second elongated member, said second latch member adapted to releasable engage said first latch member.

2. The hair styling device of claim 1, wherein said second latch member has a generally U-shaped cross section in a direction substantially normal to said longitudinal axis.

3. The hair styling device of claim 2, wherein each of said latch members includes a first segment having a free end spaced apart from an adjacent surface of its respective elongated member, each said free end cooperating with said adjacent surface to define an opening therebetween.

4. The hair styling device of claim 3, wherein said U-shaped cross section of said latch members is defined by a first segment, a second segment extending from the respective elongated member, and an intermediate segment interdisposed therebetween.

5. The hair styling device of claim 4, wherein at least one of said first and second latch members elastically deforms so as to vary the size of said opening between said free end and said adjacent surface of its respective elongated member.

6. The hair styling device of claim 5, wherein one of said free ends including a first camming surface for vertically urging the other of said free ends in response to horizontal translation of said one of said free ends.

7. The hair styling device of claim 6, wherein both of said first and second latch members are elastically deformable and further wherein said other of said free ends includes a second camming surface for vertically urging said one of said free ends in response to horizontal translation of said other of said free ends.

8. The hair styling device of claim 7, wherein said first and second latch members are each integrally constructed from an injection molded plastic.

9. A hair styling apparatus specifically adapted for styling hair in a French twist hair style, the hair styling apparatus comprising:

an upper elongated member having a first row of hair engaging teeth extending from a lower side thereof, said upper elongated member defining a longitudinal axis;

a lower elongated member having a second row of hair engaging teeth extending from an upper side thereof;

means for pivotally interconnecting a first end of each of said lower and upper elongated members; and a first latch member extending from said upper elongated member, said first latch member having a generally U-shaped cross section in a direction substantially normal to said longitudinal axis; and a second latch member extending from said lower elongated member, said second latch member adapted to releasably engage said first latch member.

10. The hair styling device of claim 9, wherein said second latch member has a generally U-shaped cross section in a direction substantially normal to said longitudinal axis.

11. The hair styling device of claim 10, wherein each of said latch members includes a first segment having a free end spaced apart from an adjacent surface of its respective elongated member, each said free end cooperating with said adjacent surface to define an opening therebetween.

12. The hair styling device of claim 11, wherein said U-shaped cross section of said latch members is defined by a first segment, a second segment extending from the respective elongated member, and an intermediate segment interdisposed therebetween.

13. The hair styling device of claim 12, wherein at least one of said first and second members elastically deforms so as to vary the size of said opening between said free end and said adjacent surface of its respective elongated member.

14. The hair styling device of claim 13, wherein one of said free ends including a first camming surface for vertically urging the other of said free ends in response to horizontal translation of said one of said free ends.

15. The hair styling device of claim 14, wherein both of said first and second latch members are elastically deformable and further wherein said other of said free ends includes a second camming surface for vertically urging said one of said free ends in response to horizontal translation of said other of said free ends.

16. The hair styling device of claim 15 wherein said first and second latch members are each integrally constructed from an injection molded plastic.

* * * * *